US006664516B2

(12) United States Patent
Chang et al.

(10) Patent No.: US 6,664,516 B2
(45) Date of Patent: Dec. 16, 2003

(54) ELECTRIC APPLIANCE WITH A PTC HEATING MEMBER AND A METHOD OF OPERATING SAME

(75) Inventors: Daniel Kee Hung Chang, Hong Kong (HK); Rhoda Chor Man Yue, Hong Kong (HK)

(73) Assignee: Halo Company, Ltd., Hong Kong (HK)

( * ) Notice: Subject to any disclaimer, the term of this patent is extended or adjusted under 35 U.S.C. 154(b) by 0 days.

(21) Appl. No.: 10/195,751

(22) Filed: Jul. 16, 2002

(65) Prior Publication Data

US 2003/0089700 A1 May 15, 2003

(30) Foreign Application Priority Data

Nov. 15, 2001 (HK) ..... 01108064

(51) Int. Cl.[7] ..... H05B 1/02; H05B 3/02
(52) U.S. Cl. ..... 219/482; 219/222; 219/505
(58) Field of Search ..... 219/222, 240, 219/242, 531, 241, 508, 505, 486, 468.1, 494, 504, 506, 533, 543, 225, 489, 492; 362/183; 363/61, 143

(56) References Cited

U.S. PATENT DOCUMENTS 3,603,765 A * 9/1971 Underwood ..... 219/222
4,029,954 A * 6/1977 Moyer ..... 362/183
4,151,401 A * 4/1979 Van Bokestal et al. ..... 219/508
4,227,535 A * 10/1980 Connor ..... 219/494
4,267,430 A 5/1981 Downey ..... 219/222
4,354,092 A * 10/1982 Manabe et al. ..... 219/225
4,791,272 A 12/1988 Thaler et al. ..... 219/222
4,968,870 A * 11/1990 Moon ..... 219/222
5,162,984 A * 11/1992 Castagnet et al. ..... 363/61

FOREIGN PATENT DOCUMENTS

| | | |
|---|---|---|
| EP | 0 269 767 A1 | 6/1986 |
| GB | 2 032 271 A | 5/1980 |
| GB | 2 154 408 A | 2/1985 |
| GB | 2 174 879 A | 4/1986 |
| GB | 2 174 896 A | 4/1986 |
| GB | 2 213 055 A | 10/1988 |

* cited by examiner

*Primary Examiner*—Tu Ba Hoang
(74) *Attorney, Agent, or Firm*—Reese Taylor

(57) ABSTRACT

There is disclosed an electric appliance (100, 200, 300, 400, 500, 600, 700, 800) with a positive temperature coefficient (PTC) heater (102, 202, 302, 506, 702) and a number of batteries (106, 206, 308, 406, 508, 606, 708, 806), in which the PTC heater (102, 202, 302, 506, 702) is adapted to be powered by the batteries (106, 206, 308, 406, 508, 606, 708, 806) and an outside electric power source, and the PTC heater (102, 202, 302, 506, 702) is adapted to be powered by the outside electric power source when the electric appliance (100, 200, 300, 400, 500, 600, 700, 800) is started, and to be subsequently powered by the batteries (106, 206, 308, 406, 508, 606, 708, 806).

41 Claims, 11 Drawing Sheets

ELECTRIC APPLIANCE WITH A PTC HEATING MEMBER AND A METHOD OF OPERATING SAME

This invention relates to an electric appliance with a positive temperature coefficient (PTC) heating member, and a method of operating such an appliance, which may, for example, be an electric hair curler.

PTC thermistors, a type of PTC heating member, are made of polycrystalline ceramic on a base of barium titanate by doping a small amount of rare earth element, e.g. yttrium (Y), lanthanum (La), etc. PTC thermistors of various shapes and specifications may, for example, be obtained from Ohizumi Manufacturing Co., Ltd. of Japan.

FIG. 1 of the accompanying drawings is a graph showing a typical electrical resistance/temperature relationship of a PTC thermistor. The electrical resistance of the PTC thermistor is measured at the ambient temperature at a voltage sufficiently low to avoid self-heating. The temperature at which the electrical resistance of PTC thermistor begins to increase rapidly is called the "curie temperature" ($T_c$), which is defined as the temperature at which the resistance value is twice that of the minimum resistance value ($R_{min}$). For the particular thermistor whose resistance/temperature relationship is shown in FIG. 1, the temperature coefficient ox, between any two temperatures ($T_1$, $T_2$) is given by equation (1) below:

$$\alpha = 2.303\frac{\log\frac{R_2}{R_1}}{T_2 - T_1}100\%/^{\circ}\mathrm{C}. \tag{1}$$

As the electric voltage applied to a PTC thermistor increases, the temperature of the PTC thermistor will rise slowly by self-heating. When the temperature approaches and eventually exceeds the curie temperature ($T_c$), the electric current will begin to decrease, as shown in FIG. 2, which shows the relationship between the electric current passing through the PTC thermistor relative to the applied voltage, at various ambient temperatures. As can be seen in FIG. 2, such a relationship is influenced by the ambient temperature. When the electric voltage is gradually increased, the temperature of the PTC will gradually increase by self-generated heat. When the temperature reaches around the curie temperature ($T_c$), it shows a negative current characteristic, namely that as voltage continues to increase, the electric current decreases. This is shown in more detail in FIG. 3, which shows the relationship between the electric current passing through the PTC thermistor with time.

It can be seen in FIG. 3 that when an electric voltage is applied to the PTC thermistor, there will be a attenuation of the current. Initially, a very large electric current will flow through the PTC thermistor. As the time of application of this voltage increases, the electric current will decrease sharply until it reaches a low level, whereupon it will remain relatively constant. This low level is well below the normal working current of a heat generating resistor, and therefore there is, in the long run, an advantage of using PTC thermistor for generating heat, in preference to a resistor.

However, the characteristic shown most clearly in FIG. 3 has hindered the use of PTC thermistors as heating elements in electric appliances with heating members, in particular those appliances with batteries (rechargeable or otherwise) for operating the heating members. As discussed above, when an electric voltage is applied to the PTC thermistor, a large electric current will initially be drawn from the power source to start up the PTC thermistor. In cases where the power source are batteries, each time of starting the electric appliance will significantly shorten the normal useful life of the batteries, as batteries are not designed to provide such a large flow of electric current. This cannot be adequately compensated, even if the electric current decreases with the passage of time to a low level.

It is thus an object of the present invention to provide an electric appliance with a PTC heating member, and a method of operating such an electric appliance, in which the aforesaid shortcoming is mitigated, or at least to provide a useful alternative to the public.

According to a first aspect of the present invention, there is provided an electric appliance with a positive temperature coefficient (PTC) heating member and at least a first electric power source, wherein said PTC heating member is adapted to be powered by said first electric power source and at least a second electric power source, characterized in that said PTC heating member is adapted to be powered by said second electric power source when said electric appliance is started, and to be subsequently powered by said first electric power source.

According to a second aspect of the present invention, there is provided a method of operating an electric appliance with a positive temperature coefficient (PTC) heating member and at least a first electric power source, including steps (a) of powering said PTC heating member by at least a second electric power source; (b) powering said PTC heating member by said first electric power source, characterized in powering said PTC heating member by said second electric power source when said electric appliance is started, and powering said PTC heating member by said first electric power source subsequently.

Embodiments of the present invention will now be described, by way of examples only, and with reference to the accompanying drawings, in which.

Figure 1:
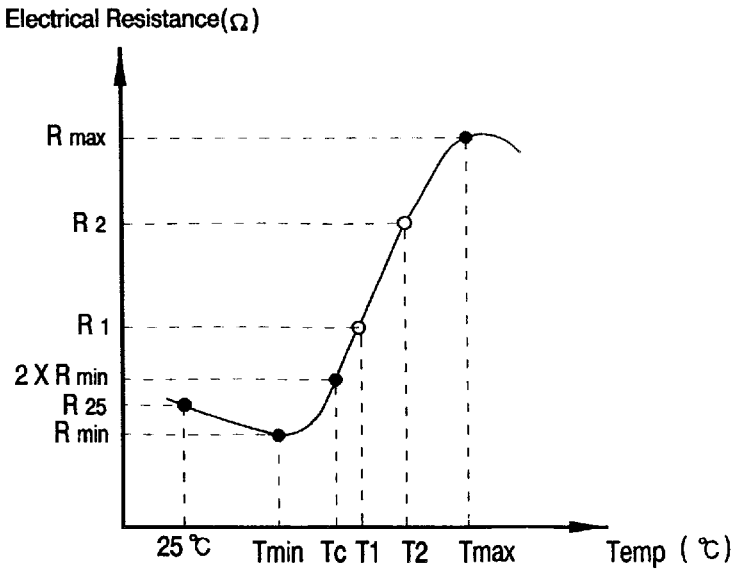
FIG. 1 shows a typical relationship between the electrical resistance and the temperature of a PTC thermistor.
Figure 2:
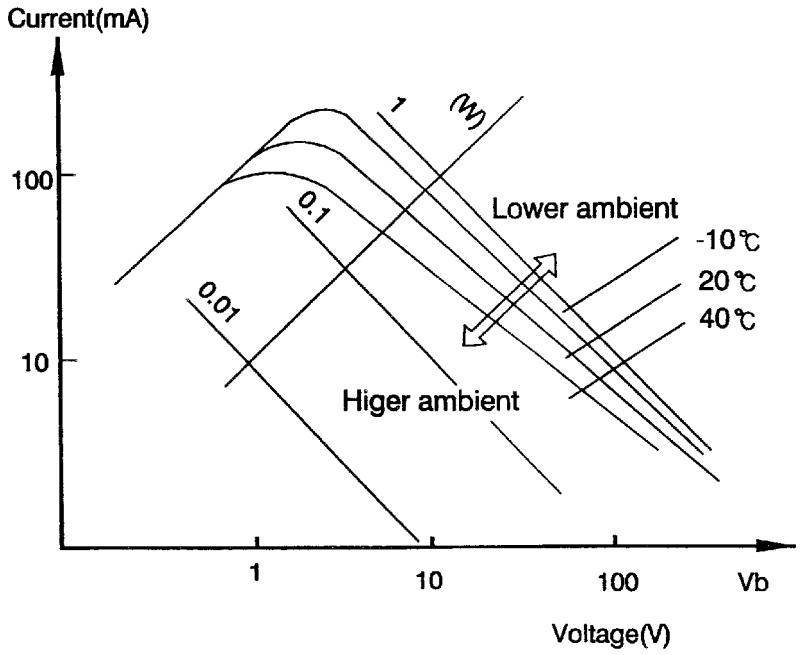
FIG. 2 shows relationship between the electric current passing through a PTC thermistor relative to the electric voltage applied thereto, at various ambient temperatures.
Figure 3:
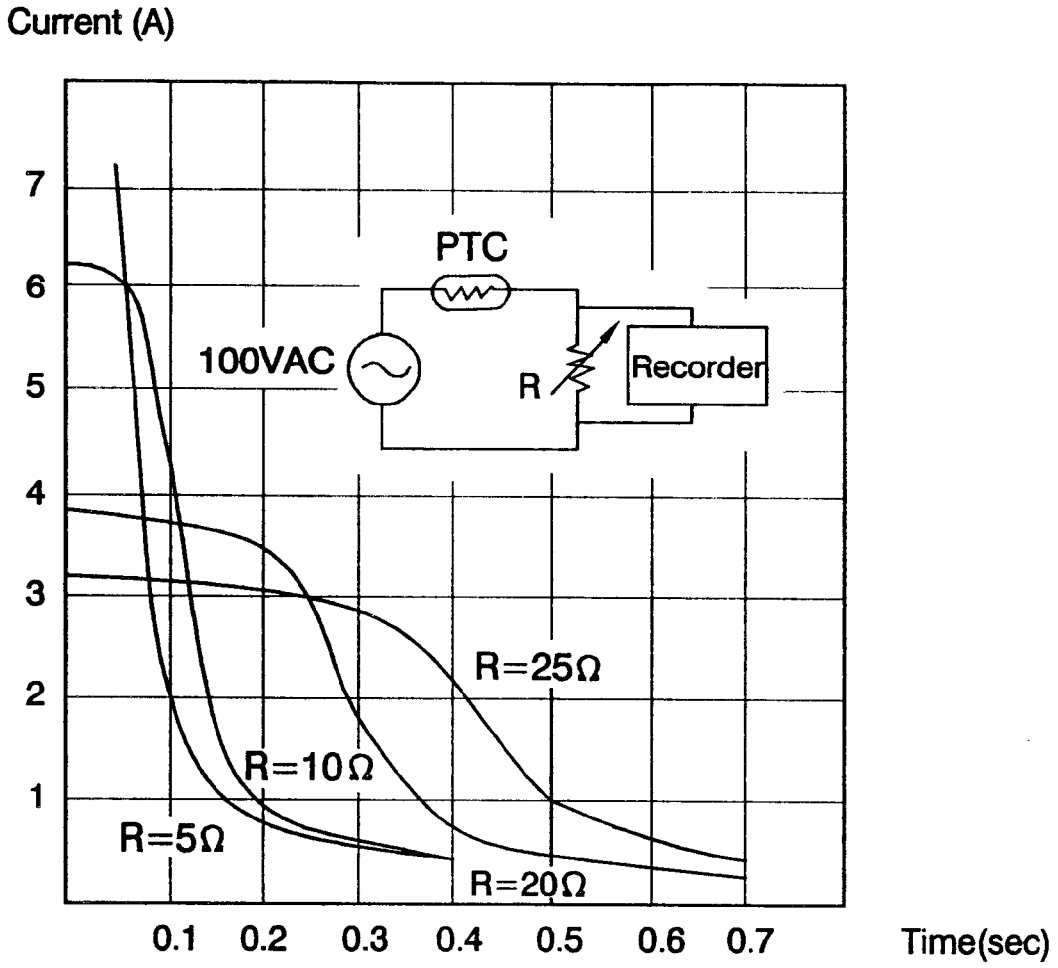
FIG. 3 shows the relationship between the electric current passing through a PTC thermistor with time.
Figure 4:
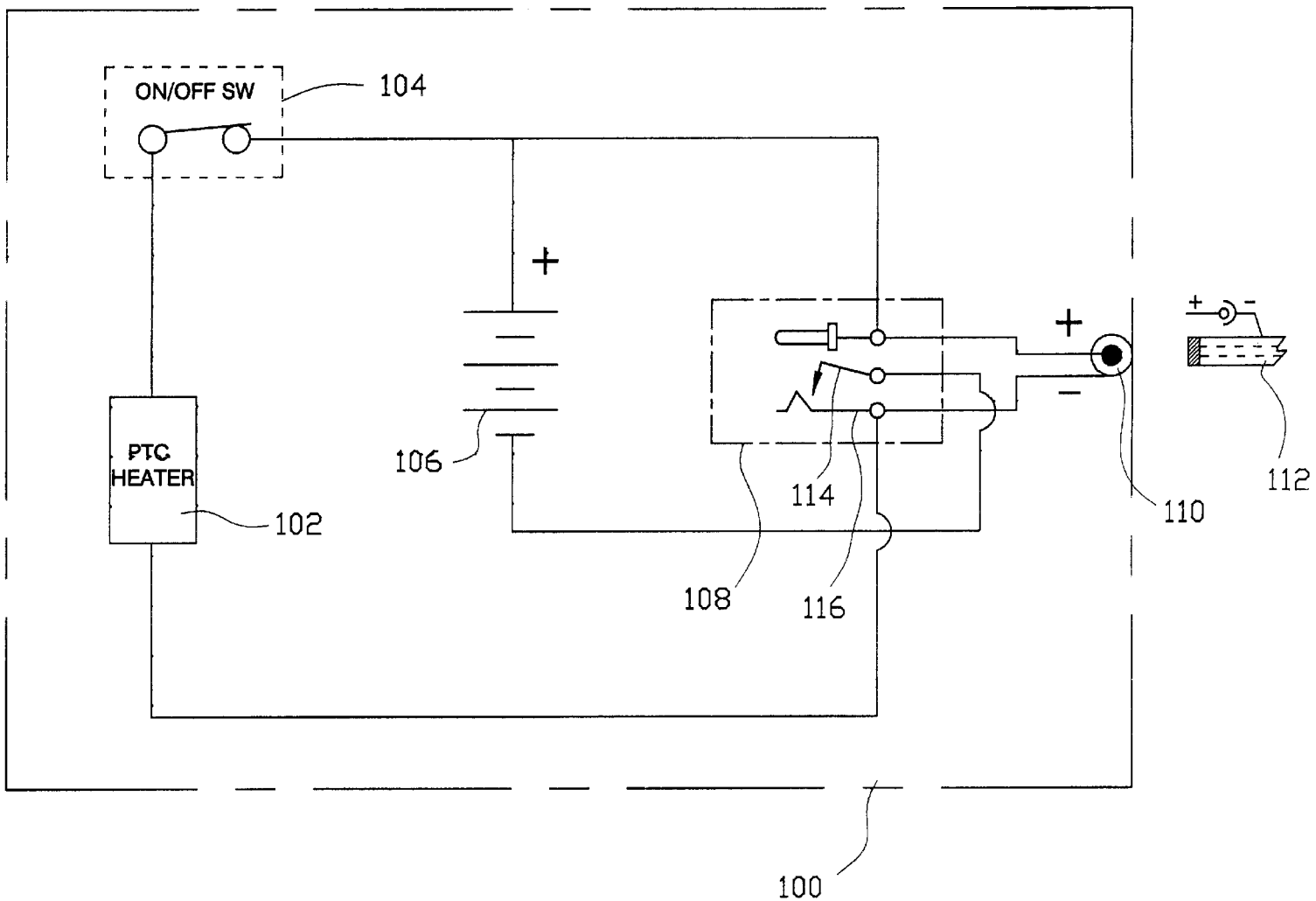
FIG. 4 is a diagram showing an electric appliance incorporating a PTC thermistor, according to a first embodiment of the present invention.

Referring to FIG. 4, such shows a circuit diagram of an electric appliance, e.g. an electric hair curler, according to a first embodiment of the present invention, generally designated as 100. The electric appliance 100 includes a positive temperature coefficient (PTC) heater 102 electrically connected via an optional on/off switch 104 to one or more batteries 106, and a power jack 108. The batteries 106 may, for example, be disposable batteries, e.g. dry batteries, or car batteries. The power jack 108 is electrically connected to a receiver 110 designed for connection with a power plug 112 connectable, probably via a transformer, to an outside electric power source, which may, for example, be a municipal a.c. source at 220 v or a car battery. The basic principle is that the batteries 106 are of a voltage of not more than 50 volts, and the outside electric power source is of a higher electric power than the batteries 106.

When the power plug 112 is connected with the power jack 108, electric power is supplied to the PTC heater by the outside electric power source. Simultaneously, a movable contact arm 114 of the power jack 108 is pushed out of contact from a stationary contact arm 116, whereby the power supply from the batteries 106 is disconnected. The electric appliance 100 then starts, and the PTC heater 102 heats up under the power supplied by the outside electric power source. A user may, when he so desires, manually remove the power plug 112 from the power jack 108, to disconnect the electric appliance 100 from the outside electric source. Upon removal of the power plug 112 from the power jack 108, the movable contact arm 114 returns, e.g. upon the action of a biasing force of a spring, to its normal state to contact and electrically connect the stationary contact arm 116, so that the PTC heater 102 is now powered, and thus heated up or kept warm, by the batteries 106, in place of the outside electric power source.

By way of such an arrangement, the very large initial electric power for starting the PTC heater 102 will be borne by the outside electric power source, and not by the batteries 106 in the appliance 100. The on/off switch 104 may be operated to connect or disconnect the electrical connection between the PTC heater 102 and the batteries 106 and/or the power jack 108, through which the PTC heater 102 is connected with the outside electric power source.

Figure 5:
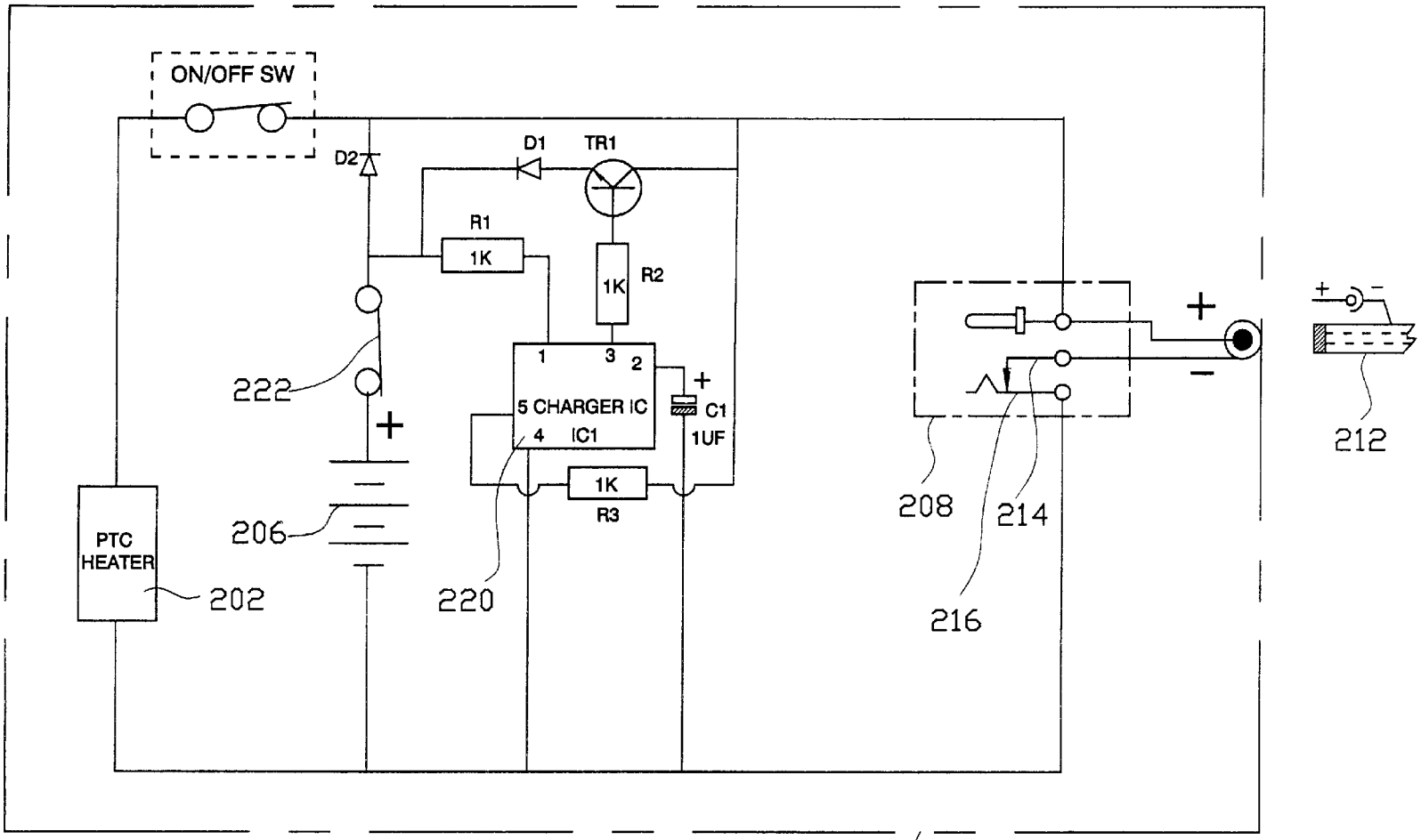
FIG. 5 is a diagram showing an electric appliance incorporating a PTC thermistor, according to a second embodiment of the present invention.

FIG. 5 shows a circuit diagram of an electric appliance according to a second embodiment of the present invention, generally designated as 200. In this electric appliance 200, when a power jack 208 is connected with a power plug 212, a movable contact arm 214 will be moved to contact and electrically connect with a stationary contact arm 216, so that if the power plug 212 is connected, e.g. via a transformer, to an outside electric power source, the electric appliance will be started, and a PTC heater 202 will be heated up, due to the passing of electricity therethrough. At the same time one or more rechargeable batteries 206 will be recharged by the outside electric power source, under the control of a charger integrated circuit (IC) 220. The rechargeable batteries 206 are also protected against overcharging by a resettable device 222 produced and traded by Raychem Circuit Protection, a division of Tyco Electronics, under the trade name PolySwitch. This device is a kind of polymeric PTC non-linear thermistor that limits the magnitude of electric current that may pass threrethrough.

At this time, the entire circuit is powered by the outside electric power source, even after the PTC heater 202 is sufficiently heated up to its steady state. When the power plug 212 is removed from the power jack 208, the movable contact arm 214 will disengage from the stationary contact arm 216 and return to its normal open position, whereupon the PTC heater 202 is then powered, and thus heated up or kept warm, by the rechargeable batteries 206 only, in place of the outside electric power source.

Figure 13:
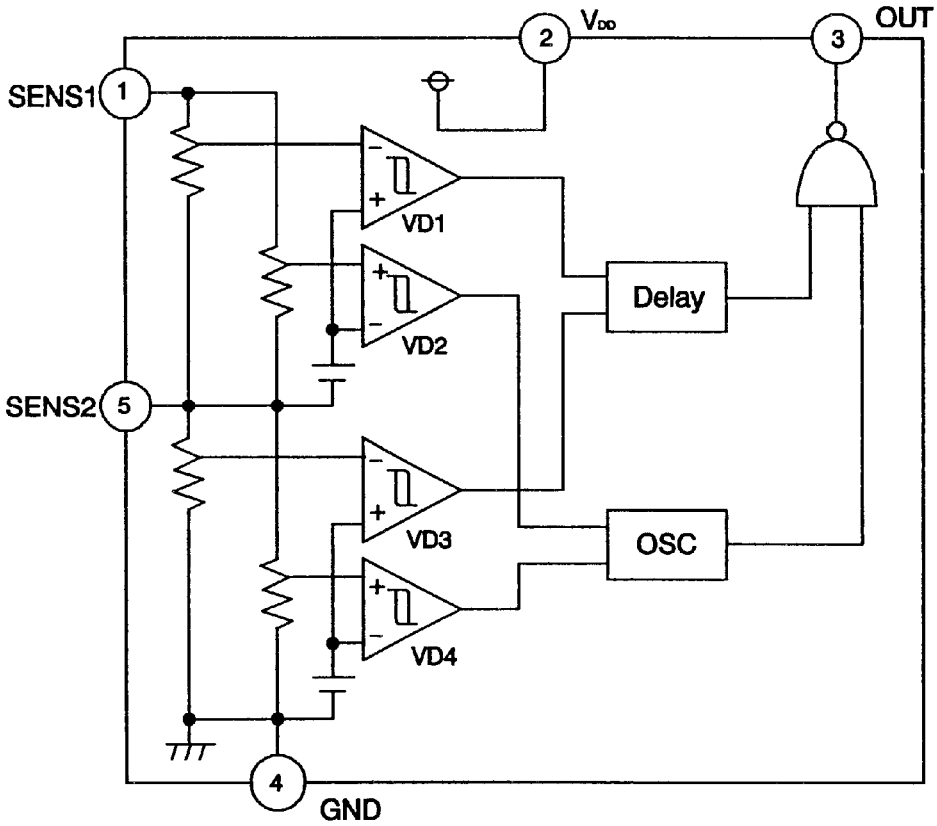
FIG. 13 shows a block diagram of an integrated circuit for regulating the charging of the battery in the electric appliances of the embodiments shown in FIGS. 5, 7, 9 and 11.

FIG. 13 shows a block diagram of a charger IC which may be used in the embodiment shown in FIG. 5 discussed above. This can be used as a protector for rechargeable Ni—Cd or Ni—MH batteries. Such an IC may be one traded by Ricoh Corporation, of USA, under its R5440N2xxA Series, which can detect over-voltage and halt a charging current. It is composed of Over-voltage detectors VD1, VD3, Low-voltage detectors VD2, VD4, an oscillator circuit, a reference unit, a delay circuit, and a logic circuit.

Figure 6:
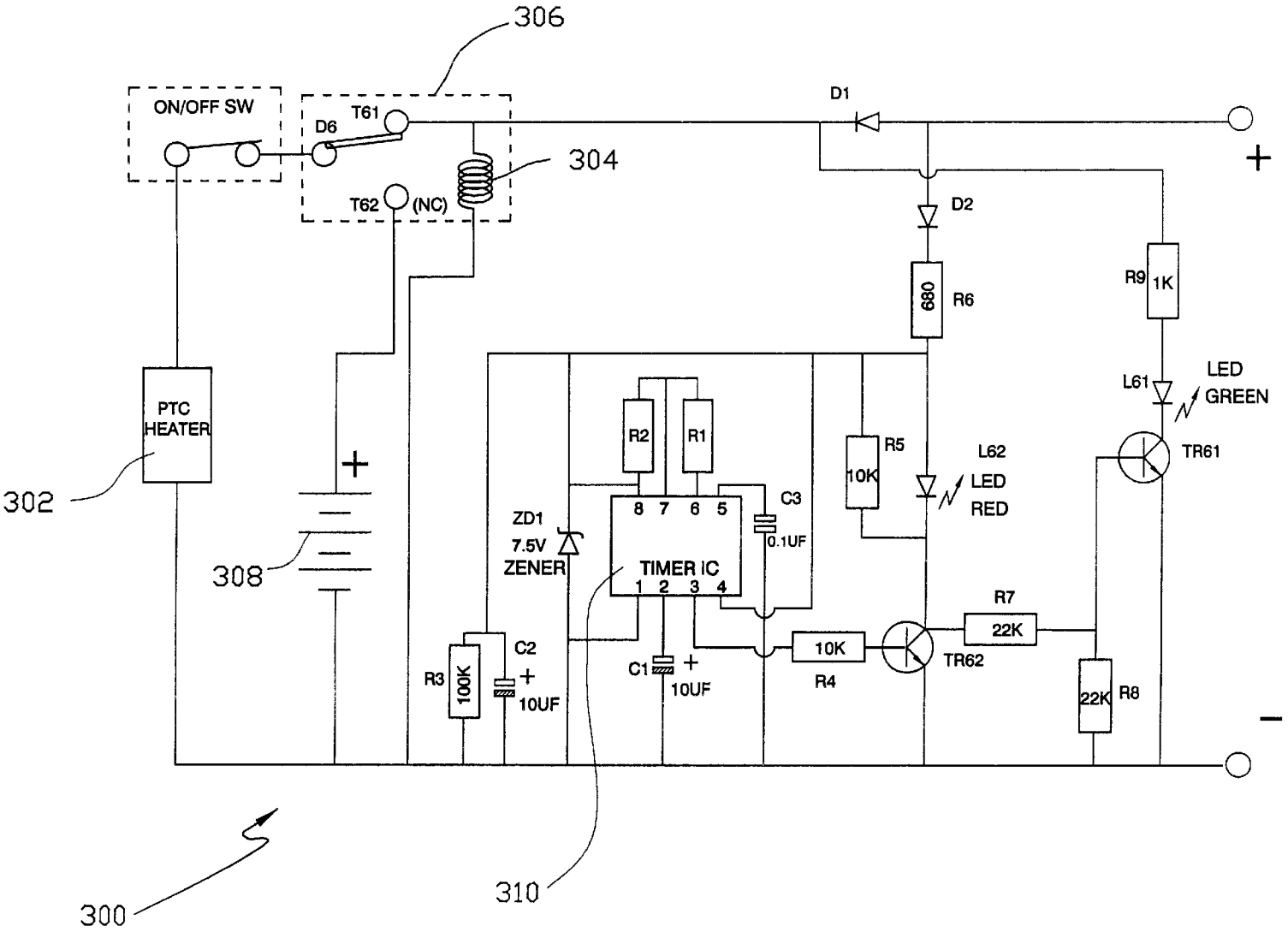
FIG. 6 is a diagram showing an electric appliance incorporating a PTC thermistor, according to a third embodiment of the present invention.

FIG. 6 shows a circuit diagram of an electric appliance according to a third embodiment of the present invention, generally designated as 300. When the appliance 300 is connected to an outside electric power source (not shown), electric current flows through a coil 304 of a relay 306, thus attracting a pole D6 of the relay 306 to connect with T61 position, thus breaking up the electrical contact between a PTC heater 302 with one or more batteries 308 in the appliance 300. The PTC heater 302 starts to heat up under the power from the outside electric power source, and a timer integrated circuit (IC) 310 starts to count down. The time T to be counted down is determined by the value of a capacitor C1 and resistors R1, R2, according to equation (2) below:

$$T=0.693(R1+2R2)*C1 \quad (2)$$

The values of C1, R1 and R2 are such that the resultant count down time T is of a sufficient duration to allow the PTC heater 302 to attain its relatively steady and low current state.

At the same time, the timer IC 310 triggers on a transistor TR62, so that electric current flows through a red light emitting diode (LED) L62 and the transistor TR62, whereupon the LED L62 lights up. When the timer IC 310 counts down to zero, the timer IC 310 resets the transistor TR62 to off. As the transistor TR62 is off, no electric current will flow through the LED L62 and the transistor TR62. Electric current instead flows through a transistor TR61, and thereby to light up a green LED L61, indicating that the PTC heater 302 has attained its relatively steady and low current state, and is thus ready for use.

When the electric appliance 300 is disconnected from the outside electric power source, no electric current will flow through the coil 304, whereupon the pole D6 will return to its normally closed (NC) position to connect with T62. The PTC heater 302 is then electrically connected with and powered, and thus kept warm or heated up, by the batteries 308.

Figure 12:
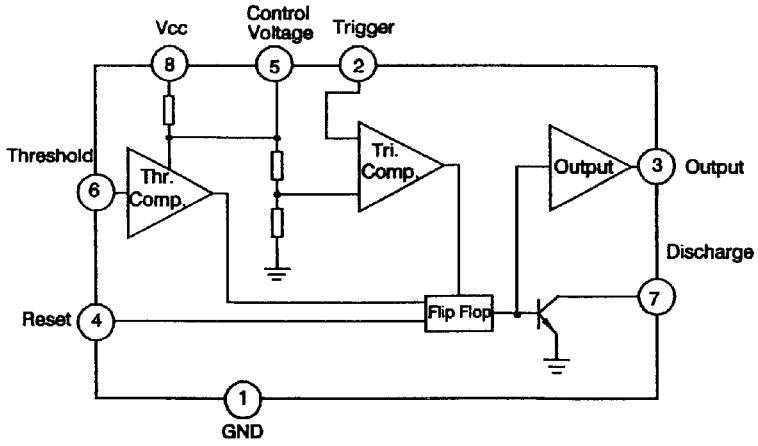
FIG. 12 shows the circuitry of a timing integrated circuit which may be used in the embodiments shown in FIGS. 6 and 7.

An integrated circuit which may be used as the timer IC 310 may be one traded by Unisonic Technologies Co., Ltd., of Taiwan, under their serial No. UTC NE555, an exemplary block diagram of which is shown in FIG. 12. When operated in an astable mode, the frequency and duty cycle of such an IC are controlled by two external resistors and one capacitor, i.e. R1, R2 and C1 in FIG. 6.

Figure 7:
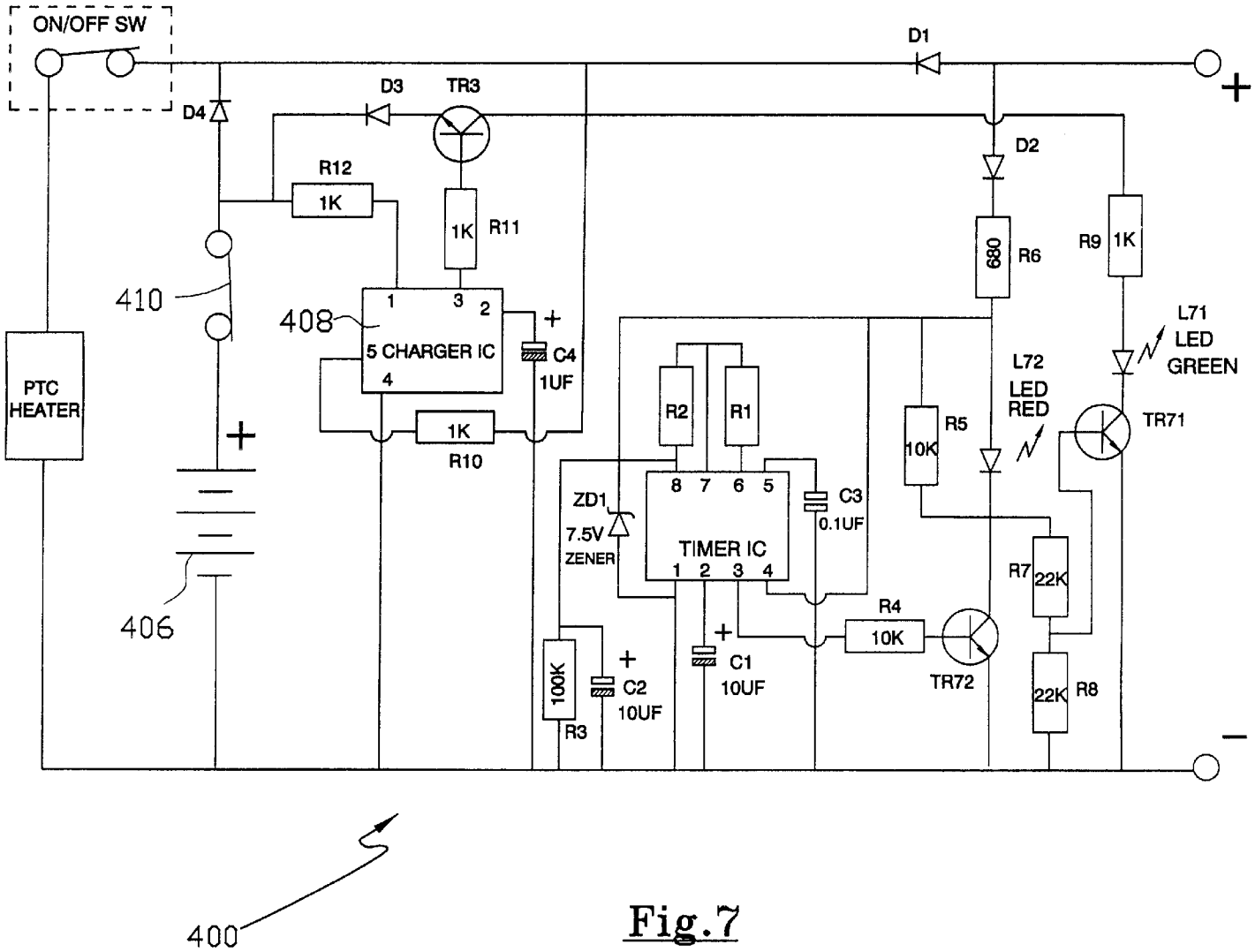
FIG. 7 is a diagram showing an electric appliance incorporating a PTC thermistor, according to a fourth embodiment of the present invention.

A circuit diagram of an electric appliance, generally designated as 400, made in accordance with a fourth embodiment of the present invention is shown in FIG. 7. This electric appliance 400 differs from the third embodiment discussed above mainly in that there are provided in the electric appliance 400 a number of rechargeable batteries 406. A charger integrated circuit (IC) 408 and a resettable device 410 are also provided to protect the rechargeable batteries 406 from being overcharged. When the electric appliance 400 is electrically connected with an outside electric power source (not shown), the rechargeable batteries 406 are recharged under the control of the charger IC 408, and the protection of the resettable device 410.

Figure 8:
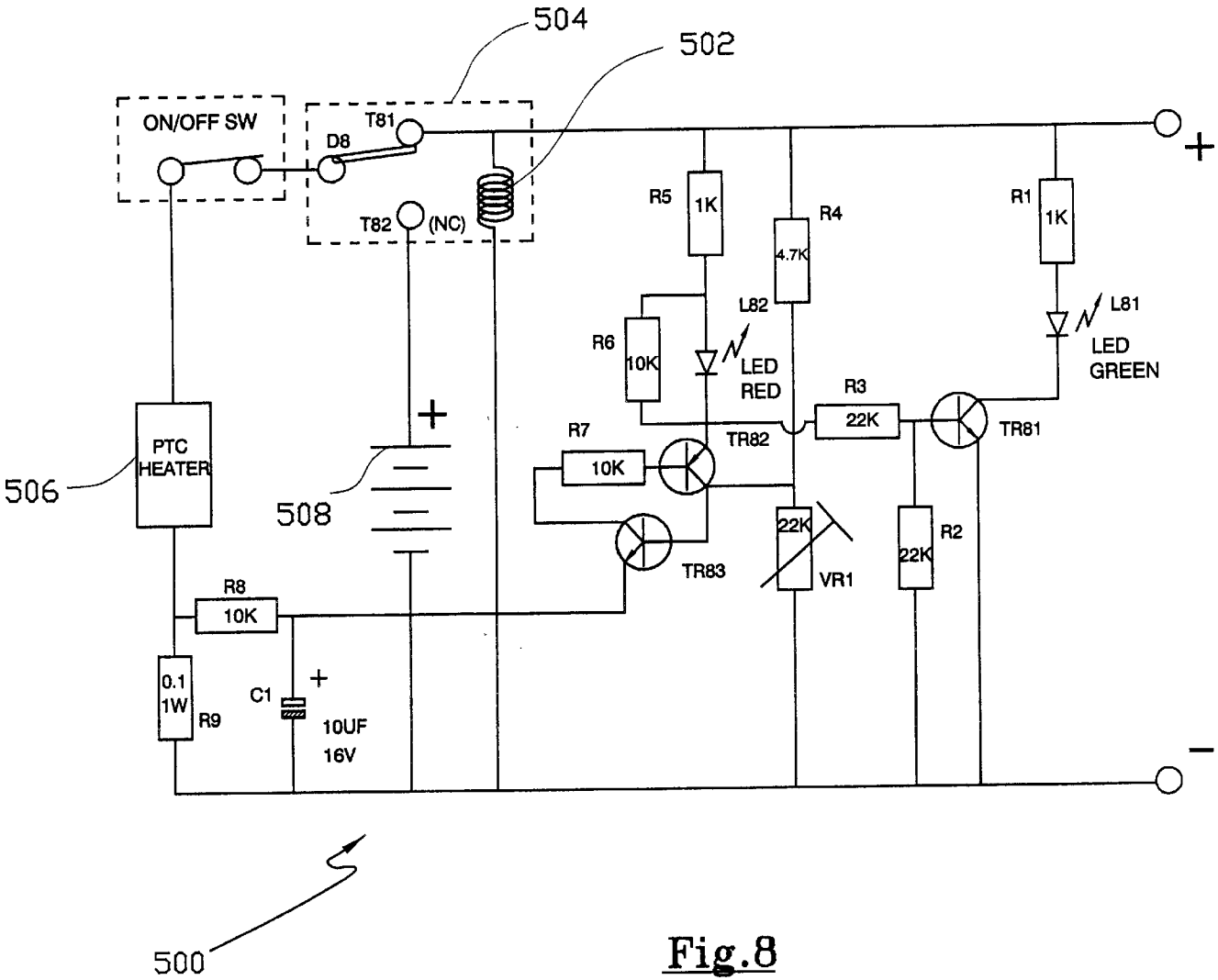
FIG. 8 is a diagram showing an electric appliance incorporating a PTC thermistor, according to a fifth embodiment of the present invention.

FIG. 8 shows a circuit diagram of an electric appliance according to a fifth embodiment of the present invention, generally designated as 500. When this electric appliance 500 is started by being electrically connected with an outside electric source (not shown), electric current will flow through a coil 502 of a relay 504, whereby a pole D8 is attracted to contact and electrically connect with a position T81. A large inrush electric current is thus drawn from the outside electric power source to power and heat up a PTC heater 506. As the circuit current is high, a transistor TR82 is triggered to switch on, so that the electric current flows through a red LED L82 and the transistor TR82, thus lighting up the red LED L82.

When the PTC heater 506 is sufficiently heated up to the steady state, the current becomes low. When a transistor TR83 senses that the electric current flowing through a resistor R9 decreases to below a predetermined reference level, the transistor TR82 is switched off. The value of the predetermined reference level is determined by the value of the power of the PTC heater 506, and the value of the input voltage of the outside electric power source. The values of resistors R8 and R9 may have to be changed in response to changes in the value of the power of the PTC heater 506, and that of the input voltage of the outside electric power source.

Upon switching off of the transistor TR82, no current flows through the red LED L82 and the transistor TR82. The electric current flows instead through a transistor TR81, and thereby to light switch on a green LED L81, signalling that the PTC heater 506, and thus the electric appliance 500, is ready for use. At this point, the whole electric appliance 500 is still powered by the outside electric power source.

When the electric appliance 500 is disconnected from the outside electric power source, no electric current will flow through the coil 502 of the relay 504, whereupon the pole D8 will return to its normally closed (NC) position to connect with T82. The PTC heater 502 is then electrically connected with and powered, and thus kept warm or heated up, by batteries 508.

Figure 9:
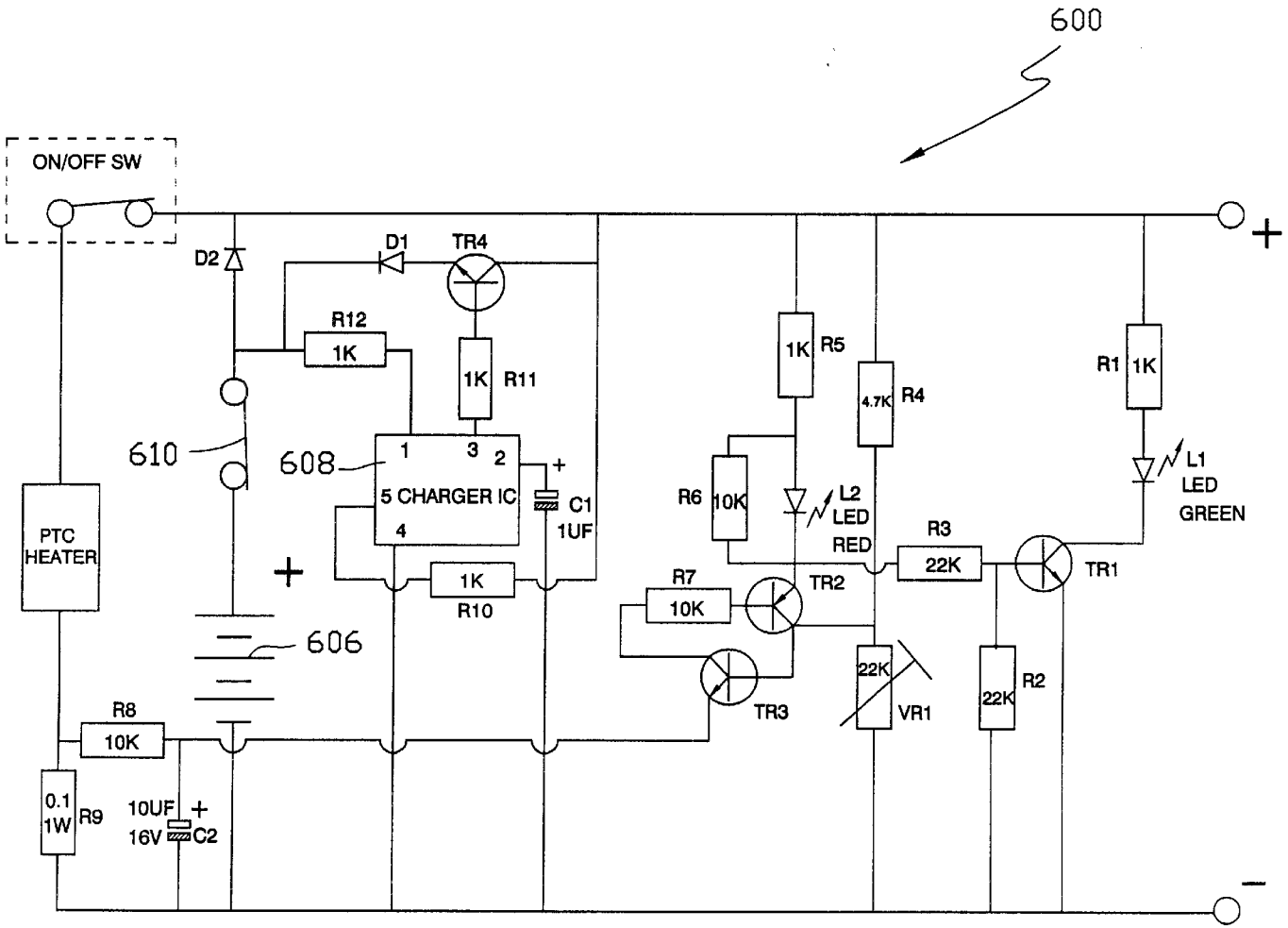
FIG. 9 is a diagram showing an electric appliance incorporating a PTC thermistor, according to a sixth embodiment of the present invention.

A circuit diagram of an electric appliance, generally designated as 600, made in accordance with a sixth embodiment of the present invention is shown in FIG. 9. This electric appliance 600 differs from the fifth embodiment discussed above mainly in that there are provided in the electric appliance 600 a number of rechargeable batteries 606. A charger integrated circuit (IC) 608 and a resettable device 610 are also provided to protect the rechargeable batteries 606 from being overcharged. When the electric appliance 600 is electrically connected with an outside electric power source (not shown), the rechargeable batteries 606 are recharged under the control of the charger IC 608, and the protection of the resettable device 610.

Figure 10:
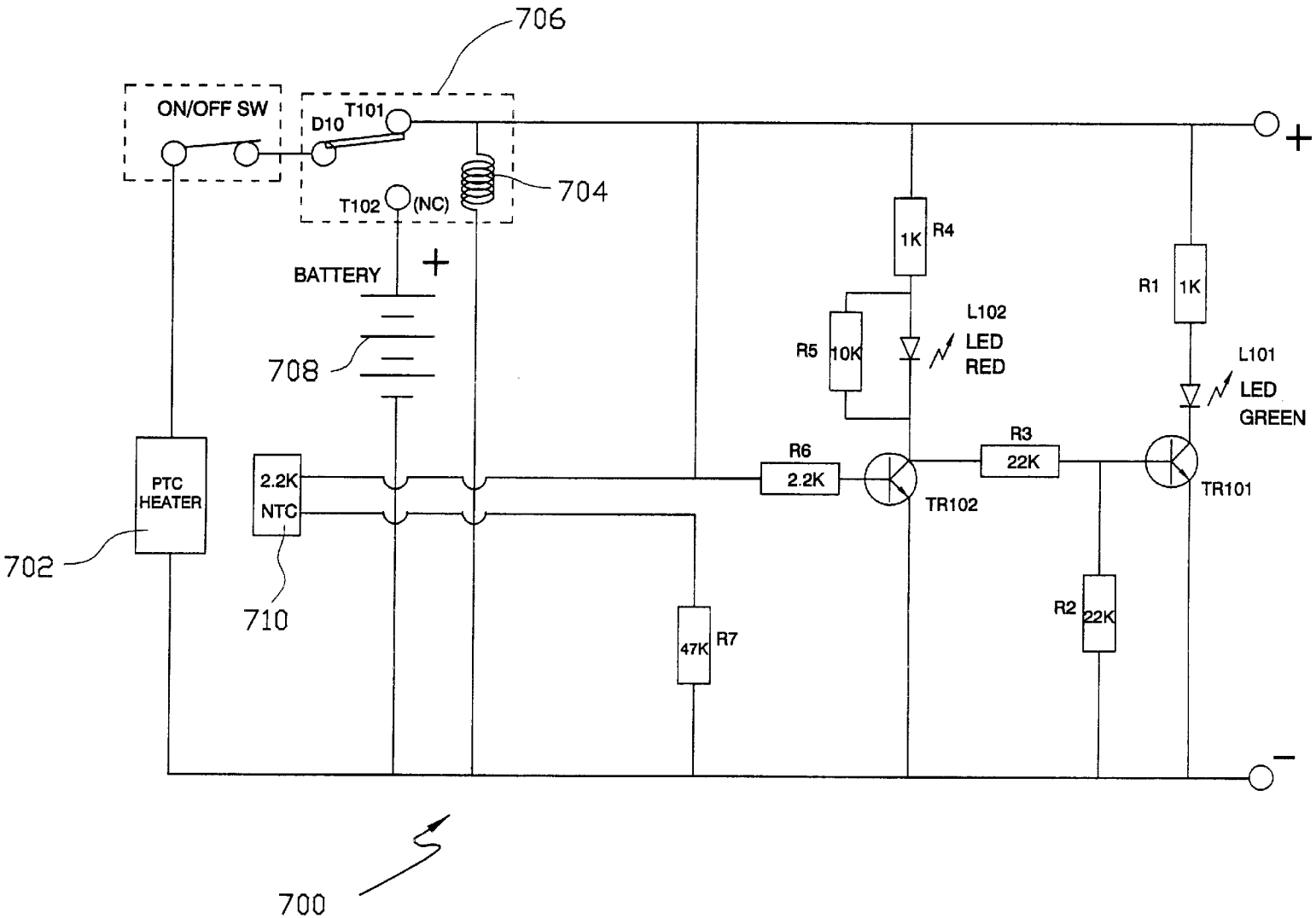
FIG. 10 is a diagram showing an electric appliance incorporating a PTC thermistor, according to a seventh embodiment of the present invention.

A circuit diagram of an electric appliance, generally designated as 700, made in accordance with a sixth embodiment of the present invention is shown in FIG. 10. When the electric appliance 700 is electrically connected with an outside electric power source (not shown), an electric current flows through a coil 704 of a relay 706, which attracts a pole D10 to contact and electrically connect with a position T101. A PTC heater 702 then heats up under the power of the outside electric power source. At the same time, a negative temperature coefficient (NTC) thermistor 710 positioned adjacent to the PTC heater 702 is at a high resistance state. A transistor TR102 is triggered to switch on, so that electric current flows through a red LED L102 and the transistor TR102, whereupon the red LED L102 lights up.

When the temperature of the PTC heater 702 is sufficiently high, as the NTC thermistor 710 is near to the PTC heater 702, it will be heated up by the heat generated by the PTC heater 702, so that its electric resistance decreases. When the temperature of the NTC thermistor 710 rises to a predetermined reference level, its electric resistance will fall to a level at which the transistor TR102 will be switched off. Upon the transistor TR102 being switched off, no electric current will flow through the red LED 102 and the transistor TR102. Electric current instead flows through a transistor TR101, whereupon a green LED 101 will light up, indicating that the PTC heater 702 is at a steady current state, ready to be used. In the meantime, the electric appliance 700 is powered by the outside electric power source.

When the electric appliance 700 is disconnected from the outside electric power source, no current flows through the coil 704, whereupon the pole D10 will return to its normally closed (NC) position to connect with T102. The PTC heater 702 is then electrically connected with and powered, and thus kept warm or heated up, by batteries 708.

The distance between the PTC heater 702 and the NTC thermistor 710, the power of the PTC heater 702, and the input power voltage, will all affect the time duration before which the temperature of the NTC thermistor 710 rises to the predetermined reference level. The NTC thermistor 710 may be in direct contact with the PTC heater 702, or be positioned adjacent to it without touching it.

NTC thermistors which may be used in the electric appliance 700 discussed above may be ones traded by Ohizumi Manufacturing Co., Ltd. of Japan under their NGR series, with an operating temperature range of −55° C. to 300° C., or NRC series, with an operating temperature range of −20° C. to 100° C. NTC thermistors are resistors with high negative temperature coefficient of resistance. The relationship between its electrical resistance and temperature may be approximated by equation (3) below:

$$R_1 = R_0 \exp B\left(\frac{1}{T_1} - \frac{1}{T_0}\right) \tag{3}$$

in which $R_0$ is the initial electrical resistance of the NTC thermistor at temperature $T_0$ measured in Kelvin, and $R_1$ is the electrical resistance at temperature $T_1$. B is a constant for a given thermistor, and may be approximated by equation (4) below:

$$B = (\ln R_1 - \ln R_0) \Big/ \left(\frac{1}{T_1} - \frac{1}{T_0}\right) \tag{4}$$

The temperature coefficient of resistance β of the NTC thermistor can be approximated by equation (5) below:

$$\beta = \frac{1}{R}\frac{dR}{dT} = -\frac{B}{T^2} * 100\% \tag{5}$$

The relationship between the power P (which equals voltage (V) multiplies current (I)) applied to an NTC thermistor at ambient temperature ($T_0$) and the consequent temperature rise ($T_1-T_0$) due to self-heating can be approximated by equation (6) below:

$$P = V * I \quad (6)$$
$$= \delta(T_1 - T_0)$$

in which δ is the dissipation constant, normally measured in mW/° C.

Figure 11:
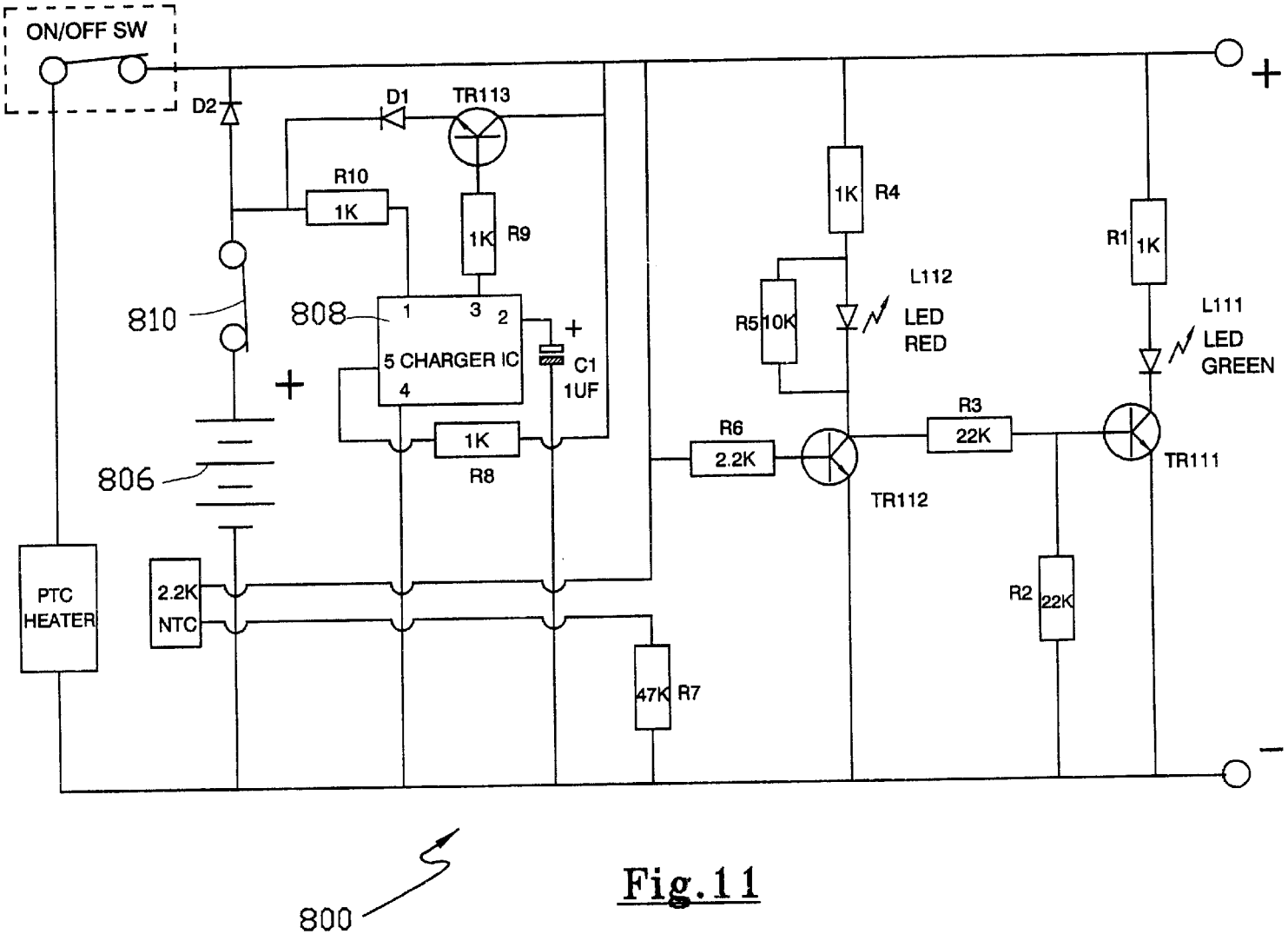
FIG. 11 is a diagram showing an electric appliance incorporating a PTC thermistor, according to an eighth embodiment of the present invention.

A circuit diagram of an electric appliance, generally designated as 800, made in accordance with an eighth embodiment of the present invention is shown in FIG. 11. This electric appliance 800 differs from the seventh embodiment discussed above mainly in that there are provided in the electric appliance 800 a number of rechargeable batteries 806. A charger integrated circuit (IC) 808 and a resettable device 810 are also provided to protect the rechargeable batteries 806 from being overcharged. When the electric appliance 800 is electrically connected with an outside electric power source (not shown), the rechargeable batteries 806 are recharged under the control of the charger IC 808, and the protection of the resettable device 810.

It should be understood that the above only illustrates examples whereby the present invention may be carried out, and that various modifications and/or alterations may be made thereto without departing from the spirit of the invention. In particular, it should be understood that the value of the various electronic components given in the drawings are examples only, and may be changed with the change of the voltage of the outside electric power source and the power of the PTC heater in the electric appliance.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

What is claimed is:

1. An electric appliance with a positive temperature coefficient (PTC) heating member and at least a first electric power source, wherein said PTC heating member is adapted to be powered by said first electric power source and at least a second electric power source, characterized in that said PTC heating member is adapted to be powered by said second electric power source when said electric appliance is started, and to be subsequently powered by said first electric power source.

2. An electric appliance according to claim 1 further characterized in that said PTC heating member is adapted to be powered subsequently by said first electric power source in place of said second electric power source.

3. An electric appliance according to claim 1 or 2 further characterized in that said second electric power source is of a larger electric power than said first electric power source.

4. An electric appliance according to claim 1 further characterized in that first electric power source is of not more than 50 volts.

5. An electric appliance according to claim 1 further characterized in that said first electric power source includes at least one disposable battery.

6. An electric appliance according to claim 1 further characterized in that said first electric power source is a rechargeable electric power source and is adapted to be recharged by said second electric source when said PTC heating member is powered by said second electric source.

7. An electric appliance according to claim 6 further characterized in including means for controlling the recharging of said first electric power source by said second electric power source.

8. An electric appliance according to claim 7 further characterized in that said controlling means includes at least an integrated circuit.

9. An electric appliance according to claim 6 further characterized in including means for protecting said first electric power source from being overcharged by said second electric power source.

10. An electric appliance according to claim 9 further characterized in that said protecting means comprises at least a current limiting device.

11. An electric appliance according to claim 10 further characterized in that said current limiting device comprises at least a polymeric PTC member.

12. An electric appliance according to claim 1 further characterized in that change of power source from said second power source to said first power source is adapted to be carried out manually.

13. An electric appliance according to claim 1 further characterized in including means for indicating when said PTC heating member reaches a predetermined temperature.

14. An electric appliance according to claim 13 further characterized in including at least one negative temperature coefficient (NTC) thermistor for sensing the temperature of said PTC heating member.

15. An electric appliance according to claim 14 further characterized in that the electric resistance of said NTC thermistor is adapted to fall to a predetermined level when the PTC heating member reaches said predetermined temperature.

16. An electric appliance according to claim 1 further characterized in that including means for indicating when the electric current flowing through said PTC heating member falls below a predetermined level.

17. An electric appliance according to claim 1 further characterized in including means for indicating when said PTC heating member has been powered by said second electric power source for a predetermined period time.

18. An electric appliance according to claim 17 further characterized in that said predetermined period of time is measured by at least an integrated circuit.

19. A method of operating an electric appliance with a positive temperature coefficient (PTC) heating member and at least a first electric power source, including steps (a) of powering said PTC heating member by at least a second electric power source; (b) powering said PTC heating member by said first electric power source, characterized in powering said PTC heating member by said second electric power source when said electric appliance is started, and powering said PTC heating member by said first electric power source subsequently.

20. A method according to claim 19 further characterized in that said first electric power source subsequently powers said PTC heating member in place of said second electric power source.

21. A method according to claim 19 or 20 further characterized in that said second electric power source is of a larger electric power than said first electric power source.

22. A method according to claim 19 further characterized in that first electric power source is of a voltage of not more than 50 volts.

23. A method according to claim 19 further characterized in that said first electric power source includes at least one disposable battery.

24. A method according to claim 19 further characterized in that said first electric power source is a rechargeable electric power source.

25. A method according to claim 24 further characterized in including a step (c) of recharging said first electric power source by said second electric source when said PTC heating member is powered by said second electric source.

26. A method according to claim 25 further characterized in including a step (d) of controlling the recharging of said first electric power source by said second electric power source.

27. A method according to claim 26 further characterized in that said step (d) is carried out by at least an integrated circuit.

28. A method according to claim 25 further characterized in including a step (e) of protecting said first electric power source from being overcharged by said second electric power source.

29. A method according to claim 28 further characterized in that said step (e) is carried out by at least a current limiting device.

30. A method according to claim 29 further characterized in that said current limiting device comprises at least a polymeric PTC member.

31. A method according to claim 19 further characterized in including a step (f) of manually changing the power source for operating said electric appliance from said second power source to said first power source.

32. A method according to claim 19 further characterized in including a step (g) of changing the power source for operating said electric appliance from said second power source to said first power source when said PTC heating member reaches a predetermined temperature.

33. A method according to claim 32 further characterized in including a step (h) of sensing the temperature of said PTC heating member.

34. A method according to claim 33 further characterized in that said step (h) is carried out by at least one negative temperature coefficient (NTC) thermistor.

35. A method according to claim 34 further characterized in that the electric resistance of said NTC thermistor falls to a predetermined level when said PTC heating member reaches said predetermined temperature.

36. A method according to claim 32 further characterized in including a step (i) of visually indicating when the electric resistance of said NTC thermistor falls to a predetermined level.

37. A method according to claim 19 further characterized in including a step (j) of changing the power source for operating said electric appliance from said second power source to said first power source when the electric current flowing through said PTC heating member falls below a predetermined level.

38. A method according to claim 37 further characterized in including a step (k) of visually indicating when the electric current flowing through said PTC heating member falls below said predetermined level.

39. A method according to claim 19 further characterized in including a step (l) of changing the power source for operating said electric appliance from said second power source to said first power source after said PTC heating member is powered by said second electric power source for a predetermined period of time.

40. A method according to claim 39 further characterized in that said predetermined period of time is measured by at least an integrated circuit.

41. A method according to claim 39 or 40 further characterized in including a step (m) of visually indicating when said PTC heating member has been powered by said second electric power source for said predetermined period of time.

* * * * *